United States Patent [19]

Rumble

[11] 4,330,126

[45] May 18, 1982

[54] HIGH FLEX GOLF SHAFT HAVING REVERSE TAPERED BUTT SECTION

[75] Inventor: Joseph W. Rumble, Hartford, Conn.

[73] Assignee: Brunswick Corporation, Skokie, Ill.

[21] Appl. No.: 71,037

[22] Filed: Aug. 30, 1979

[51] Int. Cl.[3] ..... A63B 53/12

[52] U.S. Cl. ..... 273/80 R

[58] Field of Search ..... 273/77 R, 77 A, 80 R, 273/80 B, 81 R, 81 A, 80.9

[56] References Cited

U.S. PATENT DOCUMENTS

| | | | |
|---|---|---|---|
| 976,267 | 11/1910 | Knight | 273/80 B |
| 1,968,616 | 7/1934 | Oldham | 273/80 B X |
| 2,040,540 | 5/1936 | Young | 273/80 B X |
| 2,050,554 | 8/1936 | Barnhart | 273/80 B X |
| 2,086,275 | 7/1937 | Lemmon | 273/80 B |
| 2,250,441 | 7/1941 | Vickery | 273/80 B |
| 3,606,326 | 9/1971 | Sparks et al. | 273/81 R |
| 3,802,291 | 4/1974 | Young et al. | 273/81 R X |
| 3,871,649 | 3/1975 | Kilshaw | 273/80 B X |
| 4,125,260 | 11/1978 | Kanne et al. | 273/80 R |

FOREIGN PATENT DOCUMENTS

| | | | |
|---|---|---|---|
| 320267 | 10/1929 | United Kingdom | 273/81 R |
| 404995 | 1/1934 | United Kingdom | 273/80 B |
| 427717 | 4/1935 | United Kingdom | 273/80 R |
| 447319 | 5/1936 | United Kingdom | 273/80 B |
| 447496 | 5/1936 | United Kingdom | 273/80 R |
| 470178 | 8/1937 | United Kingdom | 273/80 B |

OTHER PUBLICATIONS

"Golf Digest"; Jun. 1977; p. 13.

*Primary Examiner*—Richard J. Apley

*Attorney, Agent, or Firm*—George J. Porter

[57] ABSTRACT

A golf club shaft tapered in a step pattern and having a high deflection point is provided. The grip area has a smaller diameter than the adjacent steps of the taper of the shaft.

2 Claims, 8 Drawing Figures

R-FLEX

S-FLEX

X-FLEX

HIGH FLEX GOLF SHAFT HAVING REVERSE TAPERED BUTT SECTION

This application is related to application Ser. No. 760,518, filed Jan. 19, 1977 now U.S. Pat. No. 4,169,595 by Kaugars entitled "Light Weight Golf Club Shaft" which is included herein by reference.

BACKGROUND OF THE INVENTION

This invention relates to gold clubs.

In hitting a golf ball, deflection of the golf club shaft in the region above the head of the club adversely affects the launch angle of the ball and distance it is driven. During acceleration, in the stroke, the face of the club is deflected from its normal angle relative to the shaft and opens up at the point of contact with the ball. As a result, the launch angle of the ball is increased with a concommitant loss of distance.

This invention is directed to an improved golf club shaft having its deflection point immediately below the grip area. Control of the club is thereby maximized and hitting distance is improved since the angle of the face of the club relative to the golf ball at the point of contact remains substantially the same. This is accomplished by providing a grip area in the shaft of a smaller outside diameter than the adjacent shaft portion.

It is the primary object of this invention to provide an improved golf club shaft having a flex action such that during a stroke the angle of the face of the club relative to the adjacent shaft portion remains substantially constant.

It is a further object of this invention to provide a golf club shaft having a deflection point immediately below the grip area.

It is a further object of the invention to provide a golf club shaft having a grip area with an outside diameter less than the adjacent portion of the shaft.

Yet a further object of the invention is to provide a metal golf club shaft tapered in a step pattern having a grip area with an outside diameter less than the outside diameter of at least one of the adjacent steps.

DESCRIPTION OF THE INVENTION

The letters X, R and S employed herein to denote flex characteristics of the golf club shafts are commonly used in the art and mean respectively, extra stiff, regular and stiff. Determination of these characteristics is discussed in detail in U.S. Pat. No. 4,169,595.

Figure 1A:
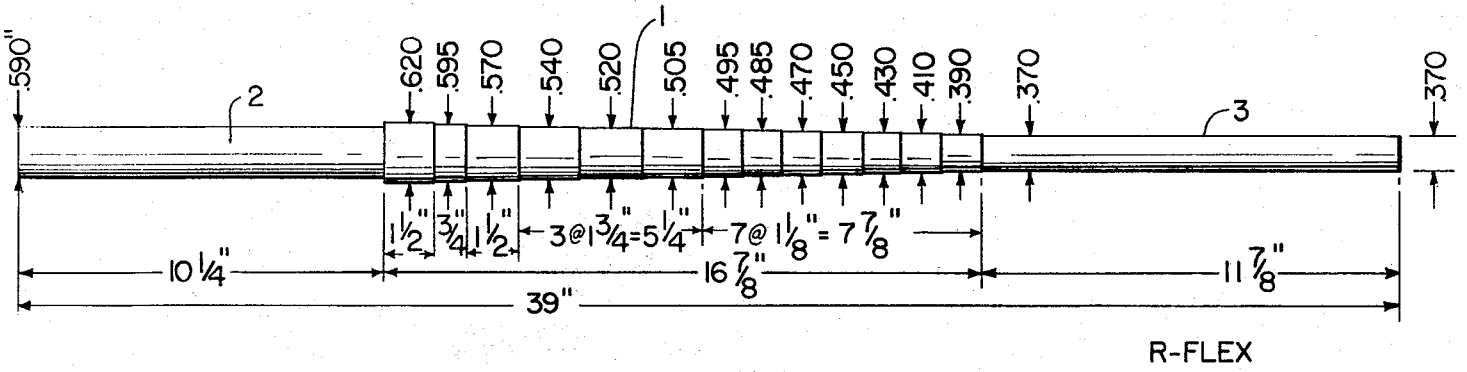
FIG. 1 gives a schematic plan view of the shafts of a series of golf club irons of X, S and R flexes with dimensions.
Figure 1B:
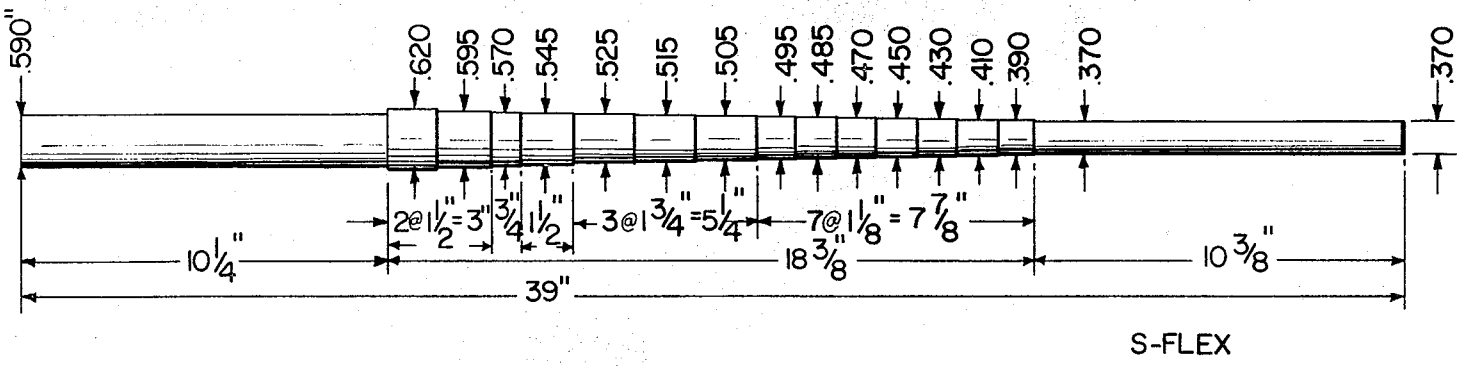
Figure 1C:
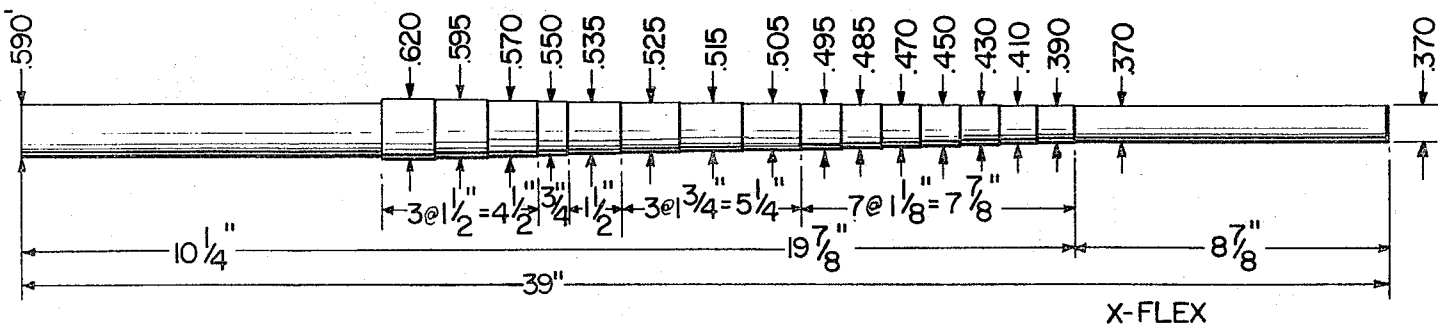

FIG. 1 shows a series of X, R and S flex shafts of alloy steel, AISI 6150, having a stepped taper section 1 a grip section 2 and a tip section 3. As shown in the drawings, the grip portion has an outside diameter which is smaller than the immediately adjacent steps of the tapered step portion 1. Tip portion 3 is shown as having parallel elements. Alternatively, the tip may be made with a taper. As discussed above, the smaller outside diameter of the grip results in the shaft having its point of deflection immediately below the grip area and relatively near the grip end of the shaft, with attendant benefits resulting therefrom. The weight of the clubs are in the standard weight category with the R, S and X clubs of FIGS. 1 and 2 weighing, respectively 4.30, 4.40 and 4.50 ounces. The wall thickness of the tubes from which the shafts are formed are generally uniform, but may be varied in specified locations. After the forming process the wall thickness at the step portions will be altered a few thousands of an inch.

Figure 3:
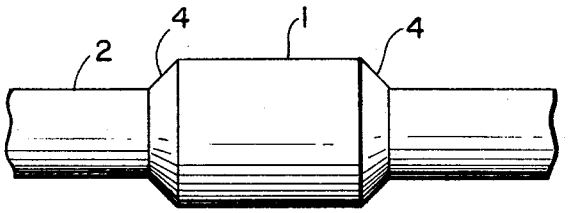
FIG. 3 is an enlargement of a portion of a shaft at the grip portion and adjacent steps showing the step structure.

FIG. 3 is an enlarged section of a portion of a shaft at the grip area. This shows more clearly how the grip area blends into the taper of the shaft and gives an improved appearance of the transition from one to the other. Numeral 4 shows the smooth transitional curves joining the steps.

Figure 4:
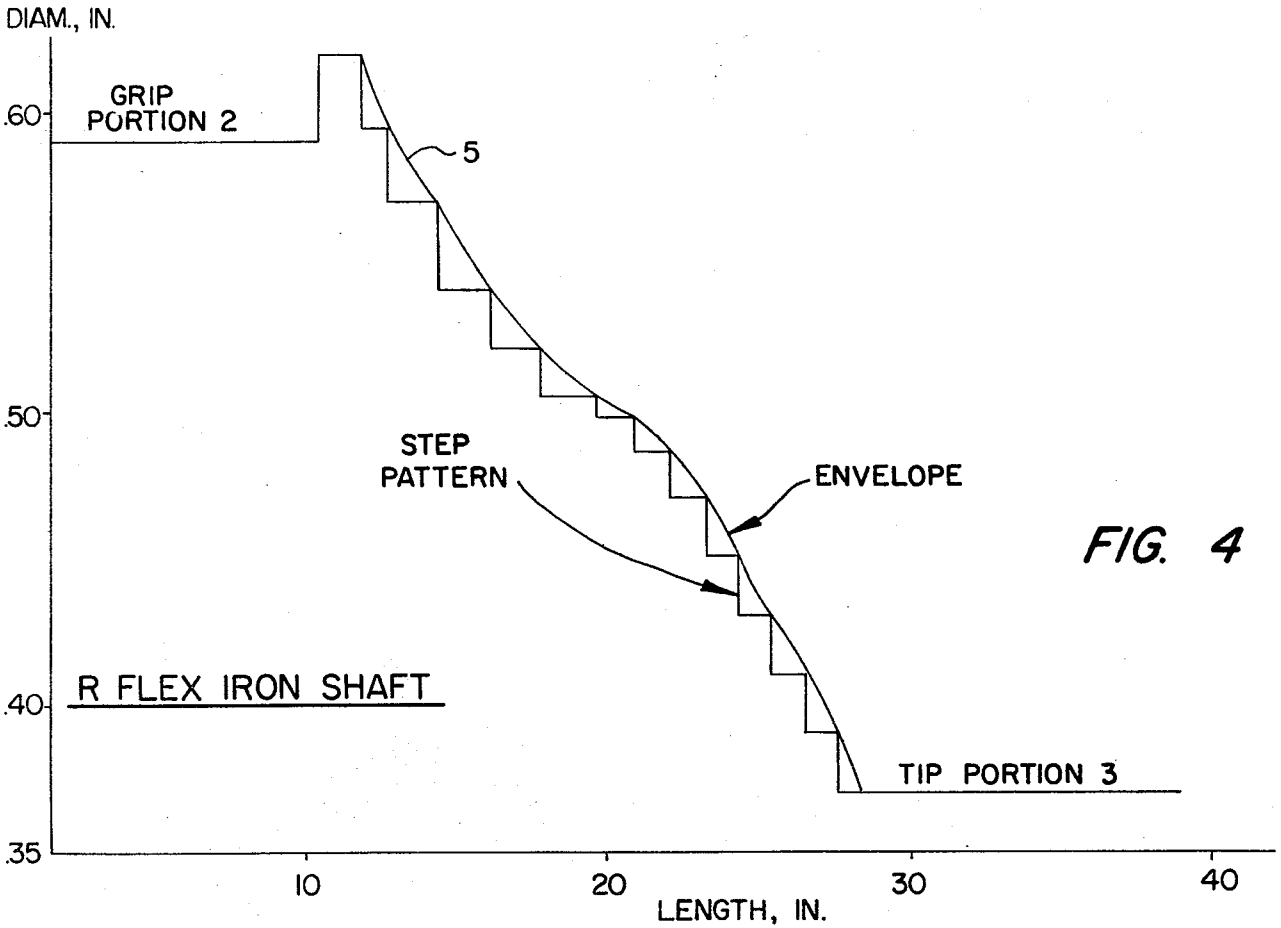
FIG. 4 shows the envelope of the step taken of the shaft of FIG. 1*a* with a greatly enlarged vertical scale.

FIG. 4 shows an envelope curve 5 formed by joining the exterior corners of the steps forming the taper. As described in application U.S. Pat. No. 4,169,595, the envelope of the step pattern characterizes the physical effects of the step pattern on the shaft flex and other play characteristics of the shaft. Step patterns other than that shown in FIG. 4 for the R-flex iron shaft, but similar thereto and falling within the same envelope, but will have the same general flex and play characteristics. Similarly, the step pattern of the other shafts of FIGS. 1 and 2 may be varied within their respective envelopes.

Figure 2A:
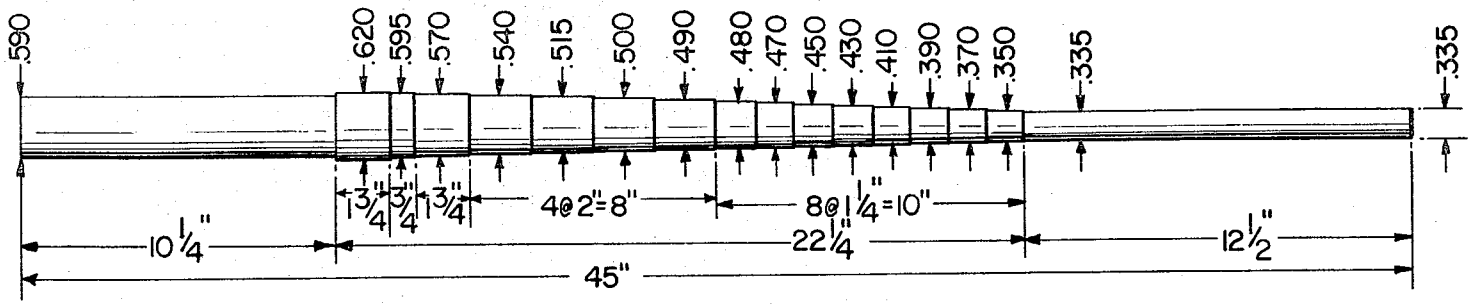
FIG. 2 gives a schematic plan view of the shafts of a series of golf club woods of X, S and R flexes, with dimensions.
Figure 2B:
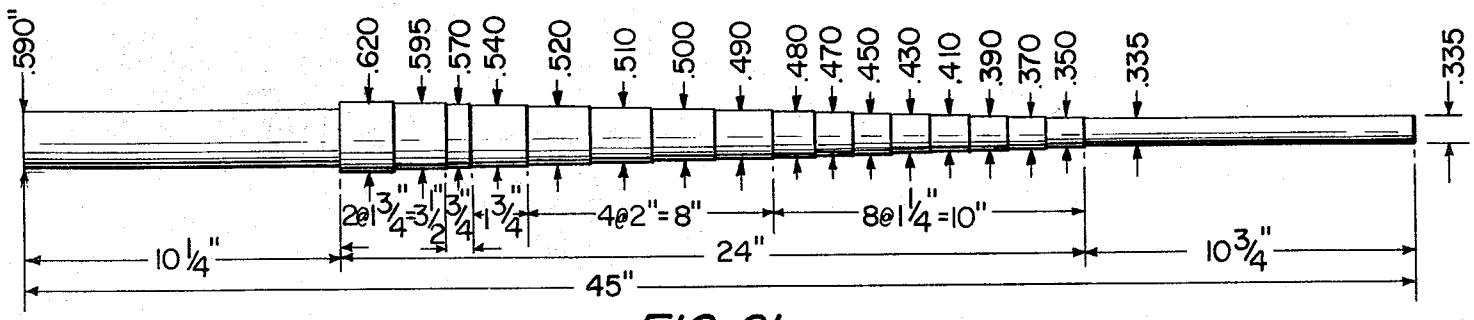
Figure 2C:
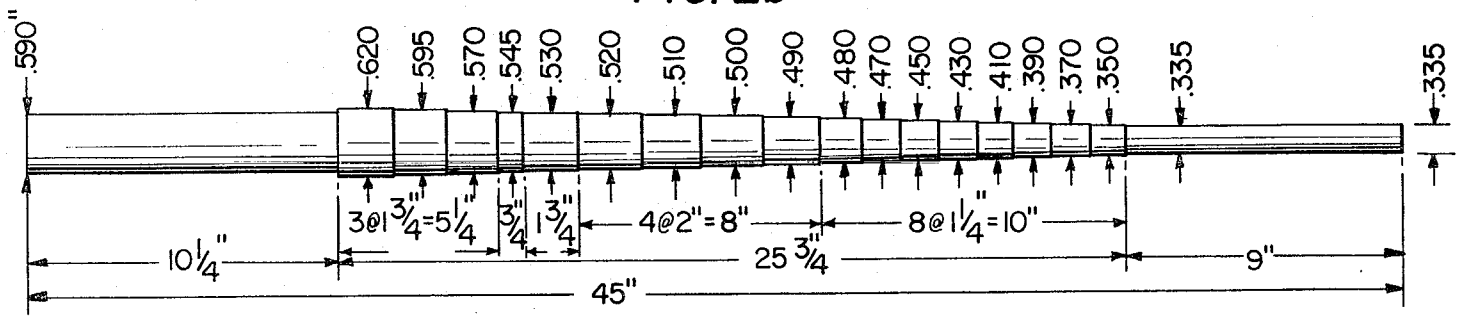

Preferably, the shaft material is an alloy steel having superior tensile, impact and yield strength as compared to carbon steel. Alloys having an after heat treatment yield point of at least 235,000 lbs./in.$^2$ and an ultimate strength of at least 265,000 lbs./in.$^2$ are employed. The shaft of FIGS. 1 and 2 are formed of AISI 6150, a chrome vanadium steel. Examples of other alloys which may be employed are AISI 4150 and 8650. These are exampary only and their recitation is not to be construed as limited thereto.

I claim:

1. A standard weight hollow metal, golf club shaft with a grip section at one end; the grip section having a uniform outside diameter which is smaller than the diameter of the immediate adjacent portion of the shaft, whereby the point of shaft deflection during play is located immediately below the grip section, the metal of the golf club shaft having an after heat treatment yield strength of at least 235,000 lbs/in$^2$, the golf club shaft exclusive of the grip section being tapered with a step pattern chosen from the step patterns specified in FIGS. 1 and 2.

2. The shaft of claim 1 wherein the shaft exclusive of the grip section is tapered with a first step pattern having an envelope which corresponds to the envelope of a second step pattern chosen from the group of step patterns specified in FIGS. 1 and 2, the first and second step patterns being different but similar.

* * * * *